US007145515B1

(12) United States Patent
Kim

(10) Patent No.: US 7,145,515 B1
(45) Date of Patent: Dec. 5, 2006

(54) ANTENNA BEAM CONTROLLING SYSTEM FOR CELLULAR COMMUNICATION

(76) Inventor: Duk-Yong Kim, 263-41 Gomae-ri, Gheung-eup, Yongin City Kyungki-do 449-901 (KR)

( * ) Notice: Subject to any disclaimer, the term of this patent is extended or adjusted under 35 U.S.C. 154(b) by 28 days.

(21) Appl. No.: 10/944,659

(22) Filed: Sep. 20, 2004

Related U.S. Application Data

(60) Provisional application No. 60/534,350, filed on Jan. 2, 2004.

(51) Int. Cl.
*H01Q 3/00* (2006.01)

(52) U.S. Cl. ..... 343/766; 343/882; 343/757; 343/726

(58) Field of Classification Search ..... 343/766
See application file for complete search history.

(56) References Cited

U.S. PATENT DOCUMENTS 6,424,314 B1 * 7/2002 Baghdasarian et al. ..... 343/882
6,864,846 B1 * 3/2005 King ..... 343/757
2004/0113861 A1 * 6/2004 Jackson et al. ..... 343/882
2005/0122273 A1 * 6/2005 Legay et al. ..... 343/754
2005/0151691 A1 * 7/2005 Mizoguchi et al. ..... 343/726

* cited by examiner

*Primary Examiner*—Binh Van Ho
(74) *Attorney, Agent, or Firm*—Albert O. Cota

(57) ABSTRACT

An antenna beam controlling system (ABCS) for use in cellular communication systems. The ABCS allows the antenna's horizontal beam direction and horizontal beam width to be remotely adjusted for optimum reception and transmission. The ABCS, in its basic design, is comprised of at least one antenna reflector that incorporates a reflecting disk for receiving and transmitting RF signals, an antenna rotating assembly, and an electronic controller. All the elements of the ABCS are housed within an antenna enclosure, such as a radome, which is maintained in an environmentally shielded condition by a top and bottom cover. The electronic controller is designed to remotely activate the ABCS and to control and optimize the position of the antenna reflector.

4 Claims, 8 Drawing Sheets

ANTENNA BEAM CONTROLLING SYSTEM FOR CELLULAR COMMUNICATION

This patent application claims priority of Provisional Patent Application No. 60/534,350 filed Jan. 2, 2004.

TECHNICAL FIELD

The invention pertains generally to antenna control systems, and more particularly to an antenna beam controlling system for use in a cellular communication network. The inventive system remotely adjusts the antennas horizontal azimuth angle and the horizontal beam width to compensate for changes in the surrounding environment.

BACKGROUND ART

Currently wireless cell phones are used throughout the world and their use is rapidly expanding. Cell phones operate in combination with antenna cell sites that are positioned throughout a reception area to provide optimum coverage. When designing a cell site for a wireless cell communication system, the physical position and the pointing direction of a cell antenna is an important parameter in defining the cell site coverage. Therefore, many cell antennas are installed on top of buildings or on towers to extend the cell site coverage area. To install cell antennas in an outdoor environment, the antennas are mounted on top of a supporting pole installed at each cell site. To install cell antennas in an indoor environment, the antennas are mounted on a wall or ceiling. In both cases, clamping tools are used to secure the placement of the antennas.

Antenna clamping tools are used to firmly install the cell antennas on a wall or an existing structure. Installation or adjustment of antennas is not only very dangerous for technicians, as it requires the technicians to climb up to a tall tower or onto a roof and to use both hands for a long period of time, but is also very tedious, which is costly because the technicians have to repeat many of the same procedures over and over again when adjusting the antenna for optimum reception.

A typical prior art antenna beam controlling assembly is shown in FIGURE A and is comprised of five major elements: a cell antenna 10, an antenna mounting pole 18, an upper articulated mounting bracket 30, an upper clamp 24 and a lower clamp 26. The cell antenna 10 has internal reflectors (not shown) for sending and receiving RF signals and includes an upper end 12 and a lower end 14. The mounting pole 18 has an upper end 20 and a lower end 22. To the pole's upper end 20 is attached an upper clamp 24, and to the pole's lower end 22 is attached a lower clamp 26. The upper articulated mounting bracket 30 has an outer end 32 and an inner end 34. The outer end 32 is attached to the upper end 12 of the antenna 10, and the inner end 34 is attached, via the upper clamp 24, to the upper end 20 of the mounting pole 18, as shown in FIGURE A. The lower end 14 of the antenna 10 is attached via a lower clamp 26 to the lower end 14 of the antenna 10.

The installation procedure of the prior art antenna beam controlling assembly is comprised of the following steps: first, loosen a pair of nuts located on the upper clamp 24 and the lower clamp 26, which widens the space of the two clamps.

Second, adjust the lower clamp 26 to support the pole 18 and control the direction angle by rotating the antenna 10 along a known direction of an electromagnetic wave corresponding to a cell sector.

Third, loosen a pair of bolts located on the articulated mounting bracket 30 and move along the folding or the unfolding direction of the articulated mounting bracket 30 to adjust the antenna's downward tilt angle. After adjusting the downward tilt angle, tighten the pair of bolts to secure the antenna. The amount of downward tilt required for the antenna 10 is determined by reading a notch mark 36 on an angle indicator 38 located on a side of the articulated mounting bracket 30.

There has recently been a demand to change the direction of cellular antenna beams, due to changes of the topography around a cell site or the degradation of call quality in dense traffic areas. In addition, because there is usually another cell site closely situated, the interference level with other cell sites should be considered when deciding the location of a cell site. In other words, the different conditions of all cell sites should be taken into consideration. In particular, with respect to the horizontal azimuth angle (i.e., horizontal steering), the electrical horizontal beam steering, which controls the phase of signals transmitted to radiating elements, would change the direction of the beam. As a result, scan loss would occur and the sidelobes would be increased. Therefore, in case of horizontal steering, it would be effective to mechanically control the direction of the beam by rotating the antenna itself either to the right or left. In case of electrical control, the antenna must consist of at least two columns of a radiating-element-array. However, there have been some negative issues such as increased width/size of the antenna, increased design complexity, increased weight of the antenna, or an increase in manufacturing costs of the antenna products.

With the existing wireless communication cell site antenna system discussed above, it is difficult to change the direction of the antenna beam frequently because a person needs to manually adjust the antenna and therefore there is always a danger of an accident.

Recently, clamping systems have also been installed on the outside of the antenna and thus combined with the supporting mounting pole. This type of installation requires a larger space for the antenna system and does not offer a zoning friendly appearance. Vertical down-tilting, which comprises electric down-tilting by means of a phase-shifter, could maintain the shape of horizontal beams, and mechanical down-tilting could control the center part of the horizontal beams but could not effectively control the side parts of the horizontal beam shape. Therefore, electrical down-tilting is more effective.

The instant invention solves and/or eliminates many of the problems discussed above that are inherent in the prior art.

A search of the prior art patents and industry literature did not disclose an antenna beam controlling system that read on the claims of the instant application.

DISCLOSURE OF THE INVENTION

The antenna beam controlling system (ABCS) as disclosed herein is designed to be used for cellular communication networks. The ABCS is designed to remotely control the azmuth angle and the horizontal beam width of an antenna. In its basic design configuration the ABCS consists of the following elements:

- An antenna enclosure having a top cover and a bottom cover,
- At least one rotatable antenna reflector disposed within the antenna enclosure and having an upper surface and a lower surface, disposed within the radome, At least one hub interfacing with the at least one antenna reflector, At least one geared motor attached to at least one hub such that the antenna reflector rotates in a direction required to change the horizontal azimuth angle and the horizontal beam width of the antenna reflector, An electronic controller for controlling the activation of the at least one geared motor in accordance with externally applied control signals.

All of the elements are located inside the antenna enclosure, such as a radome, which is environmentally shielded by the top and bottom covers.

The rotating system controls the horizontal azimuth angles of the antenna beam by rotating about the center of the antenna reflector. The rotating system can also control the horizontal azimuth angles of the antenna beams by rotating on an upstanding pole, which is located on the back of the antenna reflector. The rotating method also enables the changes in horizontal azimuth angles of the antenna beam, horizontal beam width, and beam forming. This is accomplished by placing two antenna reflectors in a linear position, by rotating the antenna reflectors around the two linearly positioned antenna reflectors, and by rotating the two antenna reflectors around the center of each reflector.

In view of the above disclosure the primary object of the ABCS is to provide an antenna beam control system for use in a cellular communication network that can remotely control the horizontal azimuth angle and the horizontal beam width of the antenna beams by rotating the antenna reflector.

Another object of the invention is to provide an antenna beam control system for use in a cellular communication network that can control the horizontal azimuth angles of the antenna beams by installing a pole on the back of an antenna reflector and by rotating at least one antenna reflector on the pole.

Another object of the invention is to provide an antenna beam control system for use in a cellular communication network that can change horizontal azimuth angles of the antenna beam, horizontal beam width, and beam forming, by placing two antenna reflectors in a linear position, rotating the antenna reflectors around the two linearly positioned antenna reflectors, and by rotating the two antenna reflectors around the center of each reflector.

Another object of the invention is to provide an antenna beam control system for use in a cellular communication network that can reduce the size of the antenna and provide a zoning friendly appearance by putting all necessary elements into a single antenna enclosure.

Another object of the invention is to provide an antenna beam control system for use in a cellular communication network that can adjust the horizontal beam pointing angle of an antenna by a mechanical operation and control the horizontal beam pointing angle remotely through a remote control method.

Another object of the invention is to provide an antenna beam control system for use in a cellular communication network that can remotely control the horizontal beam pointing angle of an antenna by a mechanical operation, achieve horizontal beam steering even with an antenna having single column radiating elements.

Another object of the invention is to produce a ABCS that is cost effective from both a manufacturers and consumers point of view.

These and other objects and advantages of the invention will become apparent from the subsequent detailed description and the claims taken in conjunction with the accompanying drawings.

BEST MODE FOR CARRYING OUT THE INVENTION

Figure 1A:
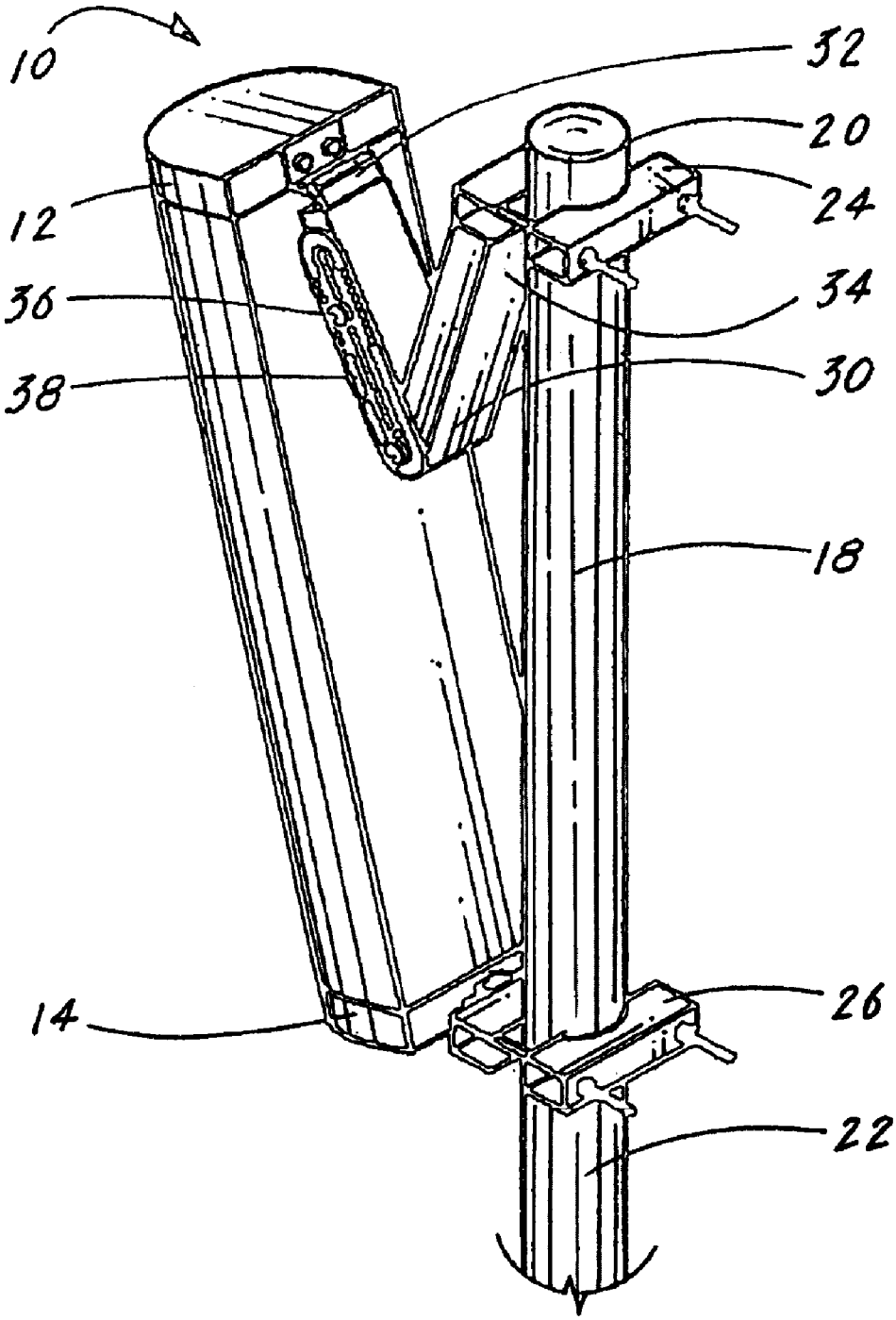
Fig. 1A PRIOR ART
FIG. 1A is a perspective view of a prior art antenna beam controlling assembly for cellular communication.

The best mode for carrying out the invention is presented is presented in terms of a preferred embodiment for an antenna beam controlling system (ABCS) for cellular communication. The preferred embodiment of the ABCS is disclosed in three design configurations: the first design is shown in FIGS. 1B–4, the second design in FIGS. 5–9, and the third design in FIGS. 10–12.

The first design configuration of the ABCS, as shown in FIGS. 1B–4, is comprised of a rotating reflecting assembly 100 that further consists of eight major elements: an antenna enclosure 181, an antenna reflector 151, a top hub 131, a bottom hub 132, a hollow offset mounting adapter 111, a speed reducing gear 142, a geared motor 161 and an electronic controller 171. The elements of the first design are shown in an exploded view in FIG. 1B and connected in FIG. 2.

Figure 1B:
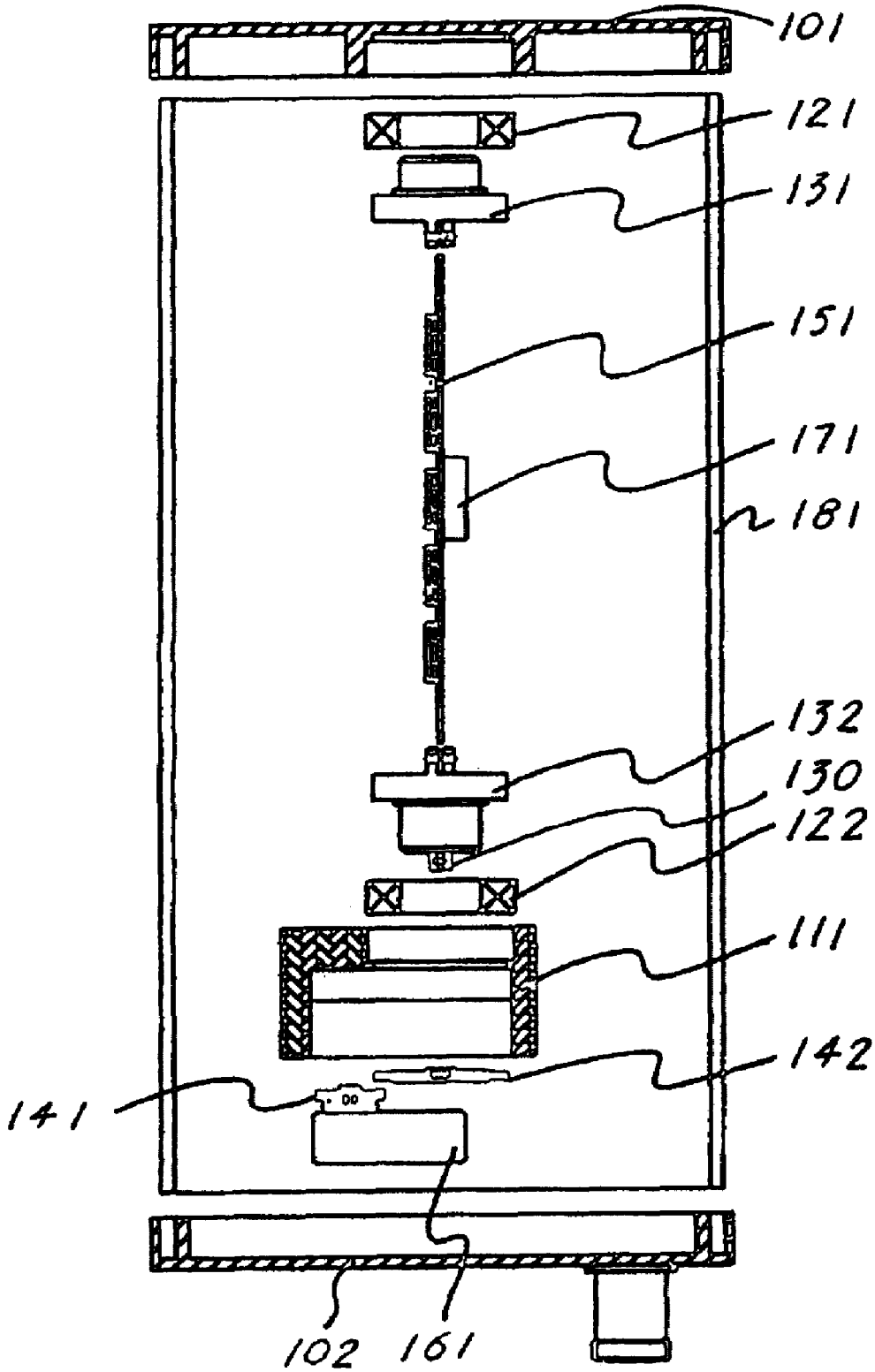
FIG. 1B is a side elevational exploded view of a first design for an antenna beam controlling system (ABCS) for cellular communication.

As shown best in FIG. 1B, the antenna enclosure 181, which preferably consists of an antenna radome, includes a top cover 101 and a bottom cover 102. Disposed within the antenna enclosure 181 are the major elements that comprise the rotating reflecting assembly 100.

Figure 2:
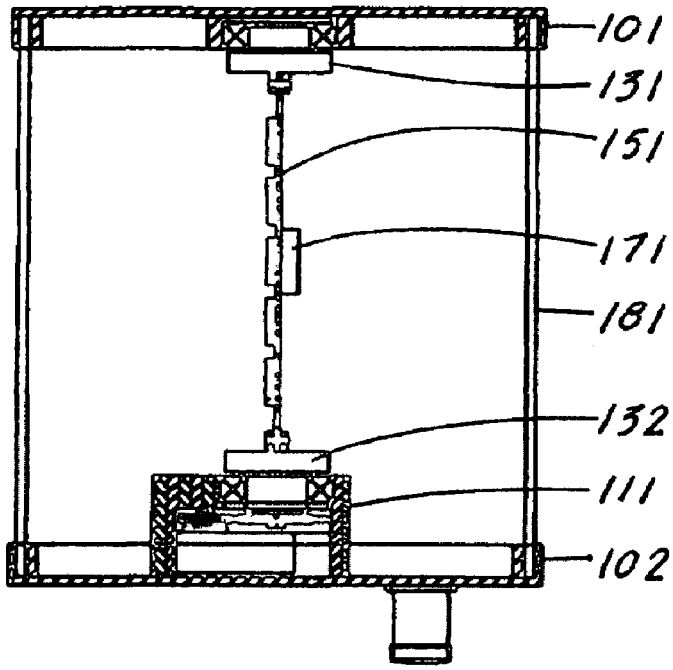
FIG. 2 is an elevational side and cross-sectional view of the system shown in the first ABCS design.
Figure 3:
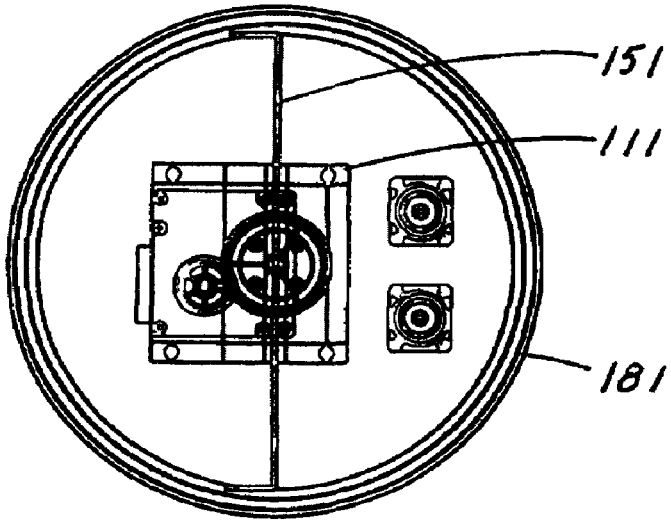
FIG. 3 is a top-plan view of the first ABCS design.

The antenna reflector 151, is shown in a side view in FIG. 2, and in a top plan view in FIG. 3, has an upper surface, a lower surface and is disposed between the top hub 131 and the bottom hub 132. The top hub 131 engages the upper surface of the antenna reflector, and includes a first bearing 121 that is press-fitted onto the top hub 131. The first bearing 121 interfaces with the top cover 101 of the antenna enclosure 181, and the bottom hub 132 engages the lower surface of the antenna reflector 151. The bottom hub 132 has an integral lower shaft 130 distending beneath the bottom hub 132 and a second bearing 122 that interfaces with the lower shaft 130.

The hollow offset mounting adapter 111 has a top and a bottom, with the top interfacing with the second bearing 122, and the bottom interfacing with the bottom cover 102 of the antenna enclosure 181. A speed reducing gear 142 is attached to the lower shaft 130 that is integral with the bottom hub 132. The lower shaft 130 is attached to the speed reducing gear 142 that is housed within the offset mounting adapter 111.

The geared motor 161 is attached to the bottom cover 102 of the antenna enclosure 181 and has attached an output gear 141 that meshes with the speed reducing gear 142. The speed reducing gear 142 rotates the antenna reflector in the direction dictated by the geared motor 161 to control the horizontal azimuth angle and the horizontal beam width of the antenna reflector 151. The direction and control of the geared motor 161 is provided by the electronic controller 171, which in turn is controlled by externally applied control signals. The externally applied control signals can be applied from a portable equipment or from a central control station.

The signals selected for transmission by the electronic controller 171 are dependent upon the cell antenna location. In order to provide an optimum cell location the cell-site location environment must be considered. These considerations include: the number and type of buildings located near the cell-site, the pattern and strength of the transmitted signal and the number of cell calls anticipated.

Figure 4:
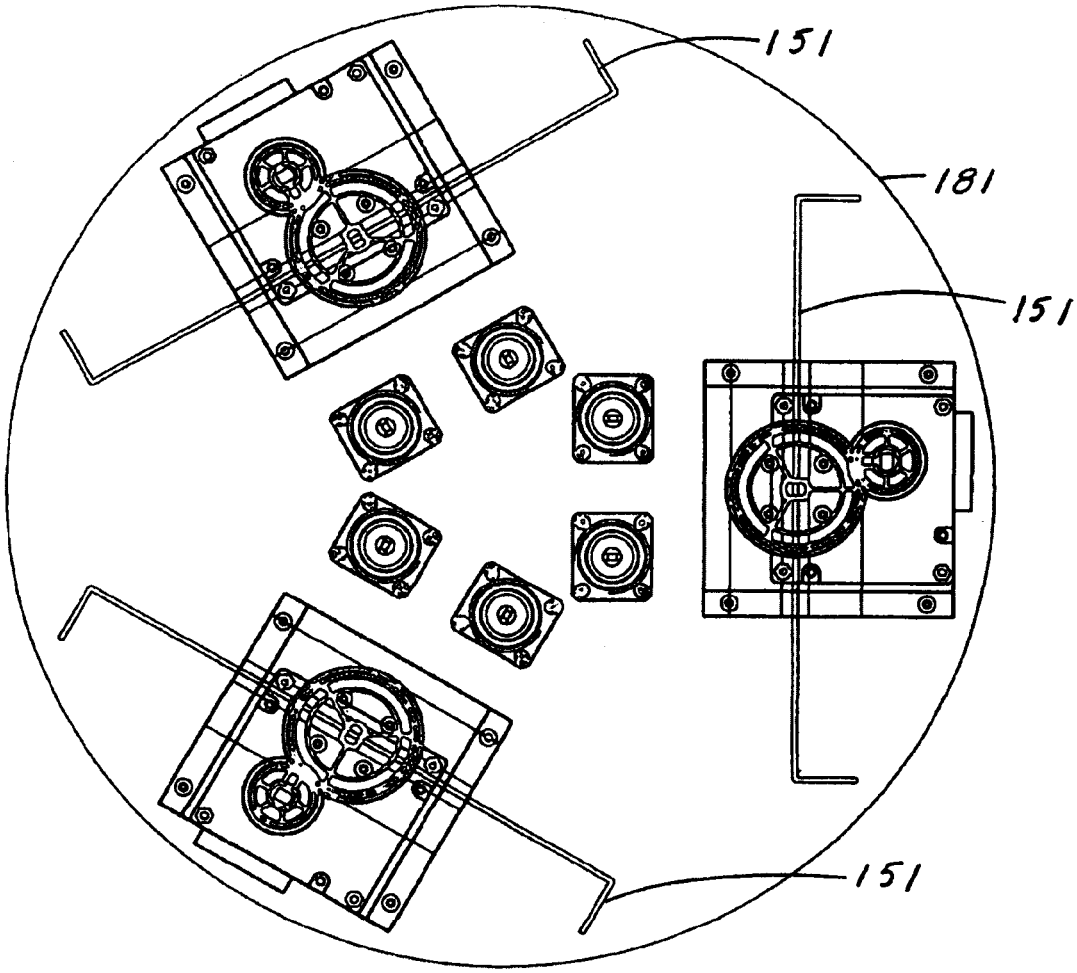
FIG. 4 is a top-plan view of the first ABCS design having three internal antennas enclosed within a single antenna enclosure.

The first design of the ABCS, as shown in FIG. 4, can be further comprised of at least three rotating reflectors. The three reflectors in this design are mounted on a common base.

The second design configuration of the ABCS, as shown in FIGS. 5–9, is comprised of a rotating reflecting assembly 100 that further consists of nine major elements: an antenna enclosure 281, a support mounting pole 211, a plurality of sleeves 231,232,233, a plurality of bearings 221,222,223, a set of antenna mounting brackets 291,292, an antenna reflector 251, a bottom hub 242, a geared motor 261 and an electronic controller 271.

Figure 5:
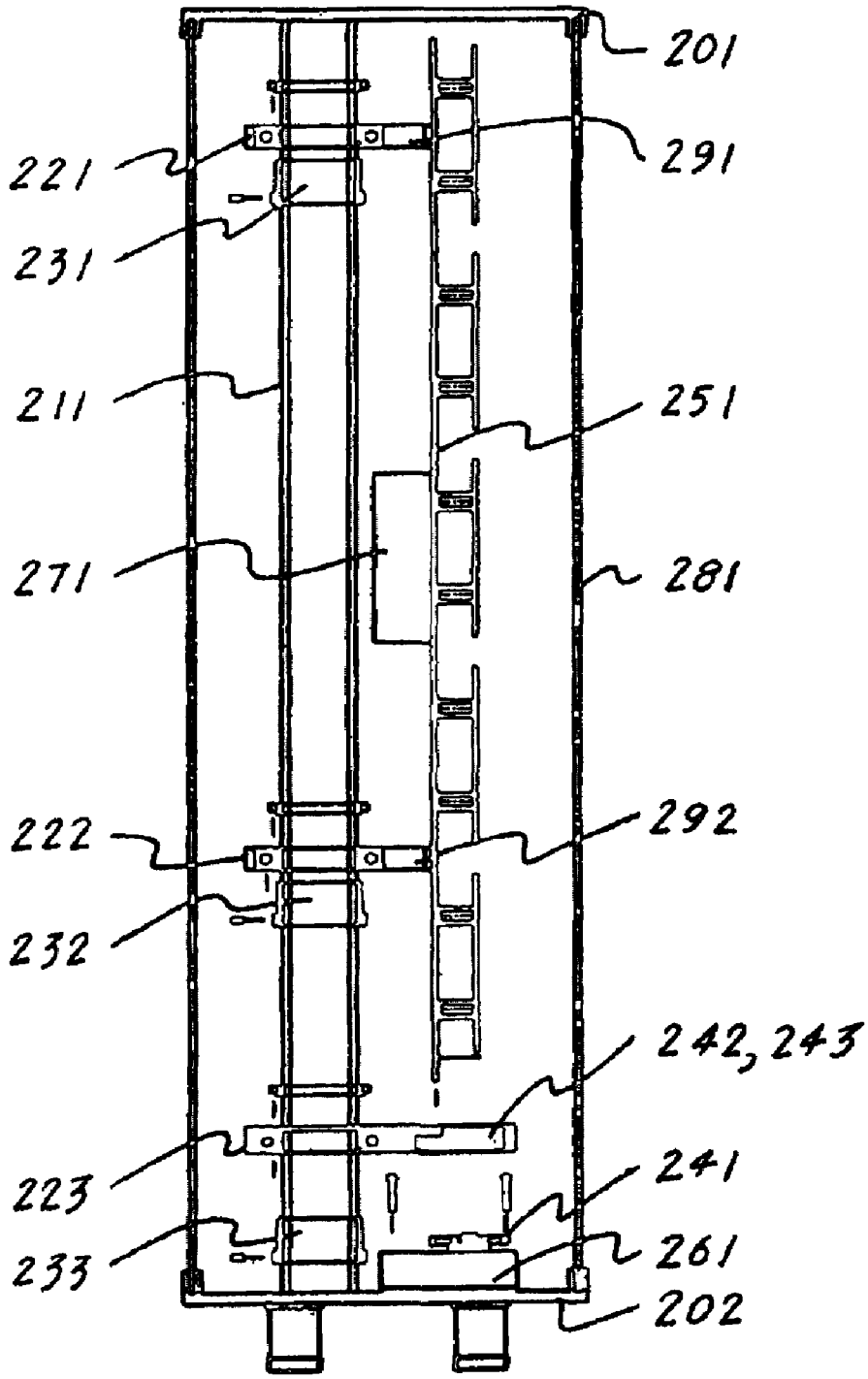
FIG. 5 is an elevational side and cross-sectional view of a second ABCS design.

As shown best in FIG. 5, the antenna enclosure 81, which preferably consists of an antenna radome, includes a top cover 201 and a bottom cover 202. Disposed within the antenna enclosure 281 are the major elements that comprise the rotating reflecting assembly 100.

Figure 6:
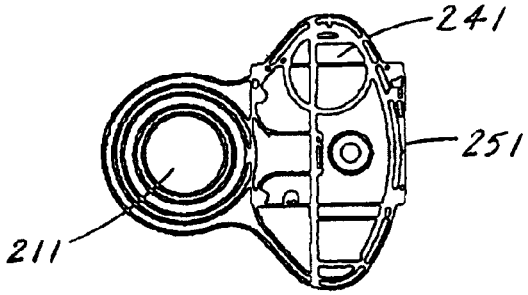
FIG. 6 is a top-plan view of the system shown in FIG. 5.
Figure 7:
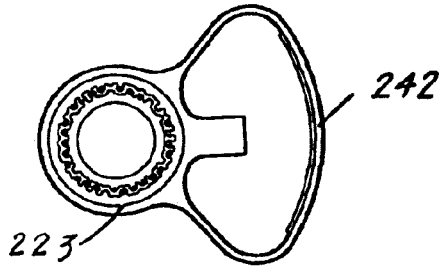
FIG. 7 is a top-plan view of the gear mechanism included in FIG. 5.

The support mounting pole 211, as shown in FIGS. 5 and 6, is dimensioned to penetrate through the top cover 201 and the bottom cover 202 of the antenna enclosure 281. Disposed around the support mounting pole is a plurality of sleeves consisting of an upper sleeve 231, a middle sleeve 232 and a lower sleeve 233. Pressed onto the inner race of the sleeves 231,232,233 is respectfully an upper bearing 221, a middle bearing 222 and a lower bearing 223.

Figure 8:
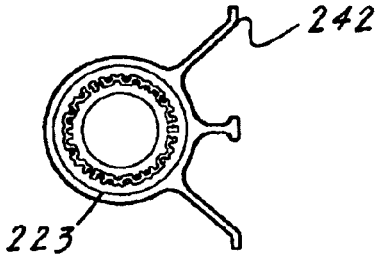
FIG. 8 is a top-plan view of the antenna mounting bracket used in FIG. 5.
Figure 9:
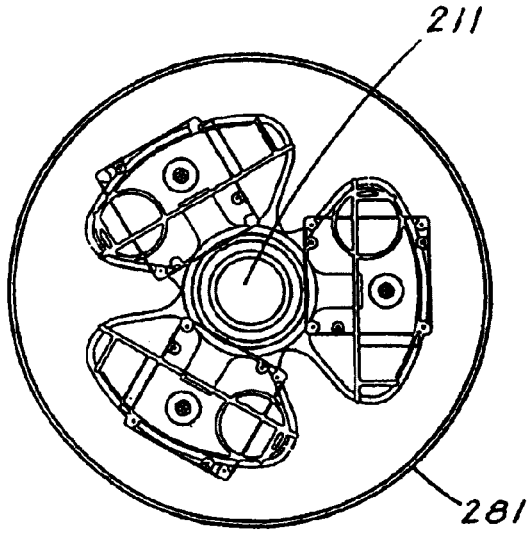
FIG. 9 is a top-plan view showing three antennas located inside the antenna enclosure.

The set of antenna mounting brackets 291,292 have inner sides that are attached to the outer race of the first bearing 221 and the second bearing 222. The outer sides of the antenna mounting brackets are attached to the antenna reflector 251, as shown in FIG. 5. The details of the antenna mounting brackets are shown in FIG. 8.

The bottom hub 242 includes a set of gear teeth 243 that interface with a lower surface of the antenna reflector 251. The gear teeth 243 are involute and are configured as a planetary gear having a radial fan shape that is compatible with the gear motor output gear. Attached to the bottom cover 202 of the antenna enclosure 281 is a geared motor 261. The geared motor 261 has an output gear that meshes with the set of gear teeth 243 on the bottom hub 242. This gearing arrangement allows the antenna reflectors to rotate in the direction dictated by the geared motor 261 to control the horizontal azimuth angle and the horizontal beam width of the antenna reflector 251. The direction and control of the geared motor 261 is provided by the electronic controller 271, which in turn is controlled by externally applied signals. The externally applied control signals can be applied from a portable equipment or from a central control station.

Figure 10:
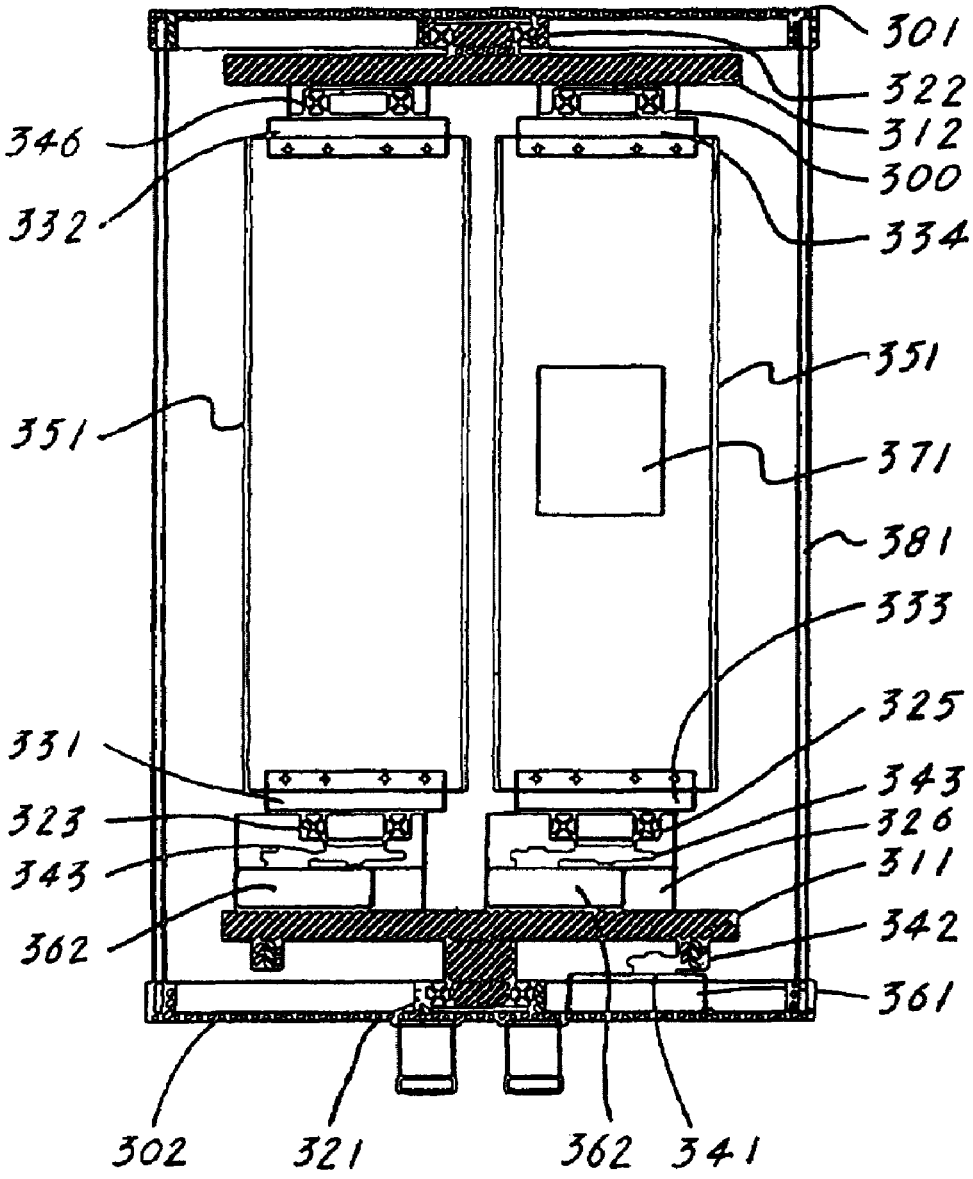
FIG. 10 is a cross-sectional view of a third ABCS design.
Figure 11:
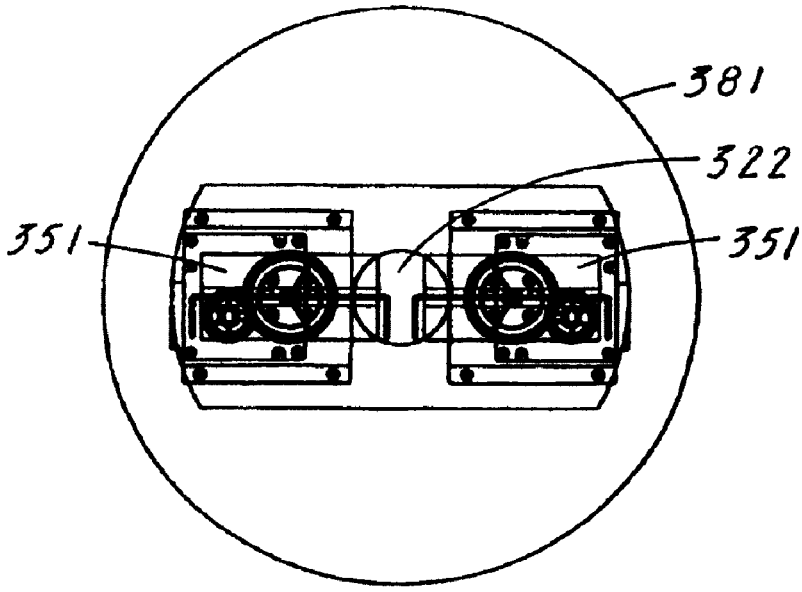
FIG. 11 is a top-plan view of the system shown in FIG. 10.
Figure 12:
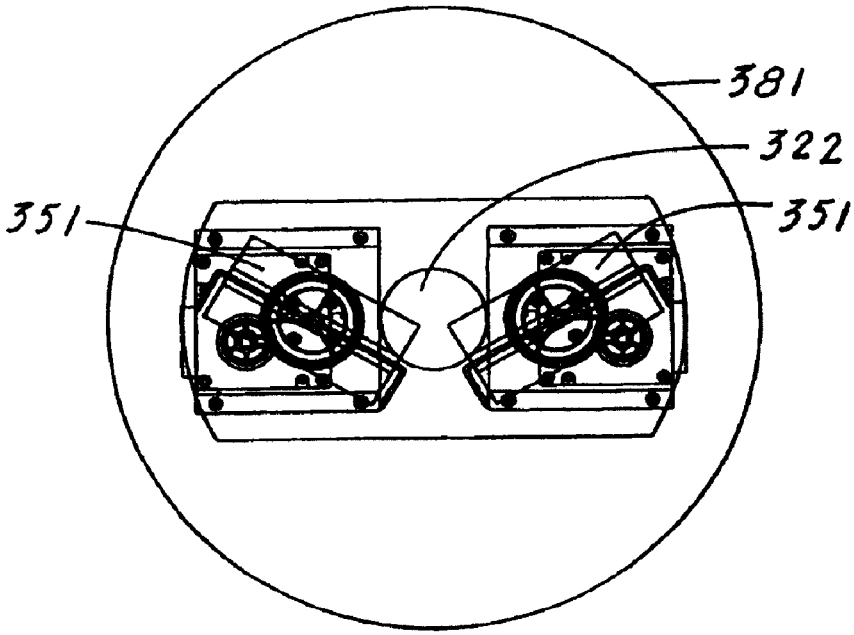
FIG. 12 is a top-plan view of the two antenna's reflectors shown in FIG. 11 at relatively rotated angles.

The third design configuration of the ABCS, as shown in FIGS. 10–12, is comprised of a rotating reflecting assembly 100 that further consists of ten major elements: an antenna enclosure 381, a top rotating disk 312, at least one top hub 300, a bottom rotating dial 311, at least one bottom hub 326, at least one antenna reflector 351, at least one speed reducing gear 343, at least one geared motor 362, a disk gear motor 361 and an electronic controller 371.

As shown best in FIG. 10, the antenna enclosure 381 which preferably consists of an antenna radome, includes a top cover 301 and a bottom cover 302. Disposed within the antenna enclosure 381 are the major elements that comprise the rotating reflecting assembly 100.

The antenna enclosure 381 includes a top cover 301 and a bottom cover 302. To the inside surface of the top cover 301 is revolvingly attached, via a disk bearing 322, a top rotating disk 312. Interfacing with a lower surface of the top rotating disk 312, via disk bearing 346, is at least one top hub 300. Likewise, to the inside surface of the bottom cover 302 is revolvingly attached, via a disk bearing 321 a bottom rotating disk 311. Interfacing with the upper surface of the bottom rotating disk 311 is at least one bottom hub 326.

Disposed within the antenna disclosure 381, between at least one top hub 300 and at least one bottom hub 326 is at least one antenna reflector 351. As shown in FIGS. 10–12, two antenna reflectors 351 are shown. Attached to the bottom hub 326, as shown in FIG. 10, is at least one speed reducing gear 343 that allows the antenna reflector to be rotated at an optimum RPM. The speed reducing gear 349 is drive by at least one geared motor 362 that is attached to the upper surface of the bottom rotating disk as shown in FIG. 10.

Located on an upper surface of the bottom cover 302 is a disk gear motor 361 that has an output gear 341 that interfaces with a disk drive gear 342 located on the bottom rotating disk 311. The combination of the disk drive motor 361 and the drive gear 342 allows at least one antenna reflector 351 to rotate in a direction dictated by the geared motor 362 to control the azimuth angle and the horizontal beam width of the antenna reflector(s) 351. The direction and control of the geared motor 362 is provided by the electronic controller 371 which in turn is controlled by externally applied control signals. The externally applied control signals can be applied from a portable equipment or from a central control station.

While the invention has been described in complete detail and pictorially shown in the accompanying drawings it is not to be limited to such details, since many changes and modifications may be made in the invention without departing from the spirit and scope thereof. For example, the disclosed cylindrical radome can be replaced with other different shaped radomes. Also, the gears and motor that provide the rotation torque can be located at various positions depending on the system design requirements. Additionally, in lieu of a gear(s) a timing belt(s) can be utilized. Hence, it is described to cover any and all modifications and forms which may come within the language and scope of the appended claims.

The invention claimed is:

1. An antenna beam controlling system for cellular communication comprising a rotating reflector assembly having:

a) an antenna enclosure having a top cover and a bottom cover, b) an antenna reflector having an upper surface and a lower surface, disposed within said antenna enclosure, c) a top hub intimately engaging the upper surface of said antenna reflector, said top hub having a first bearing pressed onto said top hub, with the first bearing interfacing with the top cover of said antenna enclosure, d) a bottom hub intimately engaging the lower surface of said antenna reflector, said bottom hub having an integral lower shaft distending beneath said bottom hub and a second bearing that interfaces with the lower shaft, e) a hollow offset mounting adapter having a top and a bottom with the top interfacing with the second bearing and the bottom engaging the bottom cover of said antenna enclosure, f) a geared motor attached to the bottom cover of said antenna enclosure, said geared motor having an output gear, g) a speed reducing gear that meshes with the output gear such that the antenna reflector rotates in the direction dictated by said geared motor to control the horizontal azimuth angle and horizontal beam width of said antenna reflector, and h) an electronic controller that controls the actuation of said geared motor in accordance with externally applied control signals.

2. The antenna beam controlling system for cellular communication as specified in claim 1 further comprising at least two rotating antenna reflectors that are mounted on a common base for a two-sector application.

3. The antenna beam controlling system for cellular communication as specified in claim 1 further comprising at least three rotating antenna reflectors that are mounted on a common base for a three-sector application.

4. The antenna beam controlling system for cellular communication as specified in claim 3 wherein each said rotating reflector can be operated individually to control the horizontal azimuth angle and the horizontal beam width.

* * * * *